US006412745B1

(12) United States Patent
Yokoyama et al.

(10) Patent No.: US 6,412,745 B1
(45) Date of Patent: Jul. 2, 2002

(54) FASTENER USING METAL AND WOODEN BOARD

(75) Inventors: Takashige Yokoyama; Takashi Fujihata, both of Osaka (JP)

(73) Assignee: Yokoyama Co., Ltd., Osaka (JP)

( * ) Notice: Subject to any disclaimer, the term of this patent is extended or adjusted under 35 U.S.C. 154(b) by 0 days.

(21) Appl. No.: 09/155,102

(22) PCT Filed: Apr. 7, 1998

(86) PCT No.: PCT/JP98/01604

§ 371 (c)(1),
(2), (4) Date: Nov. 5, 1998

(87) PCT Pub. No.: WO99/51125

PCT Pub. Date: Oct. 14, 1999

(51) Int. Cl.[7] ..... A47B 97/00

(52) U.S. Cl. ..... 248/500; 248/247; 248/300; 52/287.1; 52/313; 52/730.7

(58) Field of Search ..... 248/500, 300, 248/345.1, 505, 154, 200, 222.14, 247, 250, 188.8, 188.91, 501, 673, 680; 52/287.1, 313, 717.01, 718.01, 730.7

(56) References Cited

U.S. PATENT DOCUMENTS

| | | | | | |
|---|---|---|---|---|---|
| 1,623,892 | A | * | 4/1927 | Sobray | 248/220.21 |
| 1,679,117 | A | * | 7/1928 | Dye | 248/345.1 |
| 2,166,798 | A | * | 7/1939 | Cote | 18/59 |
| 2,208,860 | A | * | 7/1940 | Smart | 24/263 |
| 2,215,331 | A | * | 9/1940 | Marsh | 248/345 |
| 2,243,841 | A | * | 4/1941 | Bella | 248/345.1 |
| 2,292,445 | A | * | 8/1942 | Ammerman | 248/200 |
| 2,603,909 | A | * | 7/1952 | Pettibone | 248/345.1 |
| 2,683,328 | A | * | 7/1954 | Thulin | 45/137 |
| 2,782,484 | A | * | 2/1957 | Canio | 248/200 |
| 2,796,158 | A | * | 6/1957 | Miles et al. | 248/915 |
| 2,848,761 | A | * | 8/1958 | Hahn | 248/200 |
| 2,932,120 | A | * | 4/1960 | Nacionvich | 248/345.1 |
| 3,173,826 | A | * | 3/1965 | Campbell et al. | 248/345.1 |
| 3,322,389 | A | * | 5/1967 | Koral et al. | 248/345.1 |
| 3,605,360 | A | * | 9/1971 | Lindal | 52/223 |
| 3,606,229 | A | * | 9/1971 | Wall | 248/345 |

(List continued on next page.)

FOREIGN PATENT DOCUMENTS

| | | | | |
|---|---|---|---|---|
| DE | 1554341 | * | 11/1965 | 248/345.1 |
| DE | 1805100 | * | 5/1970 | 248/345.1 |
| FR | 970310 | * | 10/1948 | 248/300 |
| GB | 909976 | * | 11/1965 | 248/345.1 |
| JP | 56-27667 B1 | | 12/1976 | |
| JP | 55-93347 U | | 12/1978 | |
| JP | 59-48262 U | | 3/1984 | |

OTHER PUBLICATIONS

The New York Times, May 1981, Helpful Hardware, Isenberg et al., section C2.*

Southern Living, Aug. 1985, Built–in Shelf for Outdoor Dining.*

*Primary Examiner*—Anita King
*Assistant Examiner*—Jon Szumny
(74) *Attorney, Agent, or Firm*—Rosenthal & Osha L.L.P.

(57) ABSTRACT

A fastener (1) comprises a core plate member made of metal (11) and a decorative member made of a wooden board (12) covering the core plate member (11). The decorative member (12) is formed of a hollow wooden board whose central portion is hollowed out. The fastener (1) is formed with little or no clearance between the core plate member (13) and the decorative member (12). Wooden furniture is fastened to the building using the fastener (1). The fastener (1) does not spoil the appearance of the wooden furniture, does not make flaws easily, and does not cause sliding easily in fastening the wooden furniture to the building.

8 Claims, 13 Drawing Sheets

U.S. PATENT DOCUMENTS 4,258,473 A * 3/1981 Gutekunst ..... 30/318
4,370,373 A * 1/1983 Janiez ..... 428/151
4,710,992 A * 12/1987 Falwell et al. ..... 5/508
4,721,275 A * 1/1988 Benton et al. ..... 248/188.4
4,731,918 A * 3/1988 Burghardt ..... 29/526 R
4,792,149 A * 12/1988 Harmon ..... 280/231
4,810,550 A * 3/1989 Gasser ..... 428/100
4,883,303 A * 11/1989 Gross ..... 296/91
4,903,686 A * 2/1990 Jennings ..... 126/500
4,927,111 A * 5/1990 Takahashi ..... 248/500
4,995,181 A * 2/1991 Wolf ..... 40/152.2
5,026,588 A * 6/1991 Diekmann ..... 428/100
5,118,162 A * 6/1992 Saul ..... 297/219
5,209,983 A * 5/1993 Case et al. ..... 428/514
5,341,619 A * 8/1994 Dunagan et al. ..... 52/702
5,411,236 A * 5/1995 Morita et al. ..... 248/500
5,496,609 A * 3/1996 Michelstein ..... 428/71
5,508,078 A * 4/1996 Stalnaker ..... 428/71
5,544,866 A * 8/1996 Dye ..... 256/69
5,584,150 A * 12/1996 Newman ..... 52/204.2
5,592,901 A * 1/1997 Birmingham ..... 119/706
5,598,680 A * 2/1997 Wilhelmi ..... 52/715
5,649,436 A * 7/1997 Davidge ..... 70/18
5,707,032 A * 1/1998 Ehrlich ..... 248/205.3
5,897,086 A * 4/1999 Condon ..... 248/220.1

* cited by examiner

FASTENER USING METAL AND WOODEN BOARD

TECHNICAL FIELD

The present invention relates to a fastener, and more particularly to a fastener for fastening furniture, a desk, a shelf, or the like.

BACKGROUND ART

In offices and houses, furniture and equipment such as various housing shelves and desks are located. In such a situation, these furniture and equipment (hereinafter referred to as furniture) can move or fall down in case of an occurrence of quake such as earthquake.

In order to prevent the moving and falling down of the furniture as described above, the furniture should be fastened to the building.

Conventionally, the furniture is fastened by providing, for example, a fastener 101 as shown in FIG. 11 in a suitable position in the portion where the furniture contacts with the building. The fastener 101 is generally formed by using metal because at least a certain strength is necessary for fastening the furniture. In the fastener 101, threaded holes 102 are perforated.

FIG. 12 shows a state in which the furniture 110 is fastened to the building using the fastener 101. In FIG. 12, the furniture 110 is fastened by providing the fastener 101 in a suitable position in the portion where the side 111 of the furniture contacts with the floor 120 of the building and driving screws 103 into the side 111 of the furniture and the floor 120 through the threaded holes 102 perforated through the fastener 101 (hereinafter referred to as "fastening to the floor").

FIG. 13 also shows a state in which the furniture 110 is fastened to the building using the fastener 101 as in FIG. 12. In FIG. 13, however, the furniture 110 is fastened by providing the fastener 101 in a suitable position in the portion where the top surface 112 (or a side) of the furniture contacts with the wall 130 of the building and driving the screws 103 into the top surface 112 (or the side) of the furniture and the wall 130 through the threaded holes 102 perforated through the fastener 101 (hereinafter referred to as "fastening to the wall"). The fastening to the wall as shown in FIG. 13 is effective for fastening long narrow furniture.

In the case of fastening furniture using a fastener according to the prior art, however, the metallic fastener is visible from outside. Therefore, the metallic fastener looks bad and spoils the appearance in fastening wooden furniture. In addition, since the fastener is made of metal, the wooden furniture is easily flawed in fastening. Furthermore, the metal (the fastener) and the wood (the furniture) contact with each other in fastening the wooden furniture, so that sliding occurs easily.

SUMMARY OF THE INVENTION

In order to solve the above problems, it is an object of the present invention to provide a fastener that does not spoil the appearance of wooden furniture, does not make flaws easily, and does not cause sliding easily in fastening the wooden furniture.

In order to achieve the above object, the present invention provides a fastener having a predetermined shape, comprising a core plate member made of metal and a decorative member made of a wooden board covering the exposed portion of the core plate member. The decorative member includes a natural wood board, plywood, a synthetic, smoothly planed board, and the like. The natural wood board is most preferable.

In the fastener of the present invention, it is preferable that the decorative member made of the wooden board covers the entire core plate member.

In the fastener of the present invention, it is preferable that the decorative member is formed by using a wooden board whose central portion is hollowed out.

In the fastener of the present invention, it is preferable that the decorative member is formed by laminating wooden boards.

In the fastener of the present invention, it is preferable that the core plate member and the decorative member are integrated. The integration may be achieved by making the clearance between the hollow portion of the decorative member and the core plate member small or by adhesion of the core plate member to the decorative member.

In the fastener of the present invention, it is preferable that holes passing through the core plate member and the decorative member are formed.

In the fastener of the present invention, among the holes passing through the core plate member and the decorative member, the hole of the decorative member may be smaller than the hole of the core plate member.

In the fastener of the present invention, among the holes passing through the core plate member and the decorative member, the hole of the core plate member may be smaller than the hole of the decorative member.

Furthermore, the fastener may have any shape as long as the fastener is a material generally used as a fastener, for example, an L-type material, a T-type material, an I-type material, a flat L-type material, or a flat T-type material.

In the fastener, the core plate member made of metal may be one piece, the decorative member made of the wooden board may comprise a plurality of members, and the plurality of decorative members made of the wooden board may be integrated by adhesion.

Since the fastener according to the present invention is formed by covering the exposed portion of the core plate member made of metal with the decorative member made of the wooden board, the fastener has at least a certain strength. In addition, the decorative member serves as a cushioning material in fastening wooden furniture, so that the integrity of the furniture and the fastener in fastening the furniture improves. Furthermore, the fastener looks good and does not spoil the appearance of the furniture.

Furthermore, since the fastener according to the present invention is formed by containing the core plate member made of metal in the decorative member made of the wooden board, the fastener has at least a certain strength. In addition, the fastener does not spoil the appearance even when fastening wooden furniture. In the fastener according to the present invention, since the portion in contact with a side of the furniture (for fastening to the floor) or the top surface of the furniture (for fastening to the wall) is wood, the wood serves as a cushioning material. Therefore, flaws are not easily made. In the fastener according to the present invention, wood-to-wood contact is made between the fastener and furniture as described above. Therefore, sliding occurs less easily than in the case where metal-to-wood contact is made. Thus, a firmer fastening can be performed.

In the fastener according to the present invention, it is preferable that the decorative member is formed by using a wooden board whose central portion is hollowed out. According to the preferable example, a fastener that has a few bonding portions and provides a beautiful appearance can be obtained.

In the fastener according to the present invention, it is preferable that the decorative member is formed by laminating wooden boards. According to the preferable example, the decorative member can be formed by utilizing wood from thinning, waste wood or the like and by using members having a suitable size properly. Therefore, the decorative member can be formed relatively easily. Thus, cost reduction can be achieved.

In the fastener according to the present invention, it is preferable that the core plate member and the decorative member are integrated, that is, there is little or no clearance between them. According to the preferable example, there is little or no so called "play" between the core plate member and the decorative member. Therefore, a fastener that has at least a certain strength even when the decorative member made of a wooden board covers the core plate member made of metal can be obtained.

In the fastener according to the present invention, it is preferable that holes passing through the core plate member and the decorative member are formed and that the hole of the decorative member is smaller than the hole of the core plate member. According to the preferable example, the through-hole of the fastener is defined by the hole of the decorative member. Therefore, the fastener that provides a beautiful appearance can be manufactured relatively easily without considering the clearance between the hole of the decorative member and the hole of the core plate member.

In the fastener according to the present invention, it is preferable that holes passing through the core plate member and the decorative member are formed and that the hole of the core plate member is smaller than the hole of the decorative member. According to the preferable example, the hole of the core plate member functions as a threaded hole. Therefore, the furniture can be fastened firmly by screwing (inserting) a screw into the threaded hole (the hole of the core plate member).

Furthermore, it is preferable that the fastener is at least one material selected from the group consisting of an L-type material, a T-type material, an I-type material, a flat L-type material, and a flat T-type material, that the core plate member made of metal is one piece, and that the decorative member made of the wooden board is integrated by adhesion. According to the preferable example, a fastener can be selected according to the kind, shape, location and fastening method (for example, fastening the top surfaces of the furniture with each other) of the furniture. Therefore, fastening can be conducted properly according to the situation.

When wooden furniture is fastened by fastening a shelf, furniture or the like to at least one of the floor, ceiling and wall of the building using the fastener formed as described above, both (the furniture and the fastener) are made of wood in appearance. Therefore, the fastener looks good and does not spoil the appearance of the furniture. According to this fastening method, the portion in contact with a side of the furniture (for fastening to the floor) or the top surface of the furniture (for fastening to the wall) is wood. Therefore, the wood serves as a cushioning material, so that flaws are not easily made. Furthermore, according to this fastening method, wood and wood contact with each other as described above. Therefore, sliding occurs less easily than in the case where metal and wood contact with each other. Thus, a firmer fastening can be performed. When the furniture is fastened to at least one of the floor, ceiling and wall of the building by using the fastener in which the hole of the decorative member is smaller than the hole of the core plate member and the screw, the screw is screwed into the threaded hole (the hole of the decorative member). Therefore, the furniture can be fastened properly. When the furniture is fastened to at least one of the floor, ceiling and wall of the building by using the fastener in which the hole of the core plate member is smaller than the hole of the decorative member and the screw, the screw is screwed into the threaded hole (the hole of the core plate member). Therefore, the furniture can be fastened properly. Of course, the threaded holes of both the decorative member and the core plate member may have substantially the same diameter.

In addition, when a shelf board provided on the wall of the building is fastened by using the fastener formed as described above, a shelf that provides a beautiful appearance can be obtained. When the shelf board is fastened using the fastener in which the hole of the decorative member is smaller than the hole of the core plate member and the screw, the screw is screwed into the threaded hole (the hole of the decorative member). When the shelf board is fastened using the fastener in which the hole of the core plate member is smaller than the hole of the decorative member and the screw, the screw is screwed into the threaded hole (the hole of the decorative member). Therefore, the shelf board can be fastened properly. Thus, a shelf that provides a beautiful appearance can be obtained.

DESCRIPTION OF PREFERRED EMBODIMENTS

The core plate member made of metal used for the fastener of the present invention is preferably a metal plate that is often used as a fastener, for example, an iron plate, a stainless steel plate, or an aluminum plate, because they have a high strength. For the use of the iron plate, anticorrosive coating or galvanization may be conducted according to a common procedure.

As the decorative member made of a wooden board covering the exposed portions of the core plate member made of metal, wood, for example, Teak, Oak, Hinoki, Port-orford-cedar, Sugi, Itayakaede, Harigiri, Mizume, Udaikamba, Asada, Katsura, Sawara, Nezuko, Asunaro, Kuri, Buna, Konara, Tochinoki, Onigurumi, Kusunoki, Enju, Yachidamo(=Iasenj), Shioji, Karamatsu, Akaezomatsu, Himekomatsu, Tsuga, Yamazakura, Shiurizakura, Kihada(=Barkhat), Doronoki(=Topolj), Kouyamaki, Ichii, Aoshina, Nire(=Ilem), Keyaki, Makaba, Sen, Kaya, Hiba, Momi, Nara(=Dub), Matsu, Alder, Ash, Aspen, Basswood, Beech, Yellow birch, Paper birch, Butternut, Cherry, Coffeetree, Cottonwood, Southern cypress, Red elm, Sap and red gum, Hackberry, Hickory, Honeylocust, Koa, Magnolia, Hard maple, Soft maple, Red oak, White oak, Pecan, Persimmon, Southern yellow pine, White pine, Sassafras, Sycamore, American tulipwood, Tupelo and black gum, Black walnut, Black willow, New Guinea walnut, Jelutong, Agathis, Mersawa, Koruing, Kapur, White lauan, Red lauan, Red meranti, White seraya, Yellow meranti, White meranti, Selangan batu, Selangan batu merah, Ramin, Narra, Sepetir, Ebony, Sonokelibg, Rosewood, Teak, Lignum-Vitae, Port-orford-cedar, Alaska-cedar, Western redcedar, White oak, Black walnut, Pacific silver fir, Grand fir, Noble fir, Western larch, Western white pine, Lodgepole pine, Ponderosa pine, Engelmann spruce, Sitka spruce, Douglas fir, Western hemlock, Redwood, Pikhta, Elka, Kedr, Sosna, Bereza, Dub(=Nara), Orekh, Iasenj(=Yachidamo), Bubinga, Sapelli, African mahogany, Moabi, Makore, Radiata pine, Taiwan hinoki, Paulownia, Balsa, Mahogany, China tamo, Alerce, Araucaria, Manio, Cipress, Laurel, or Roble, can be used.

Fasteners and fastening methods according to the embodiments of the present invention will be described below with reference to the drawings.

Figure 1:
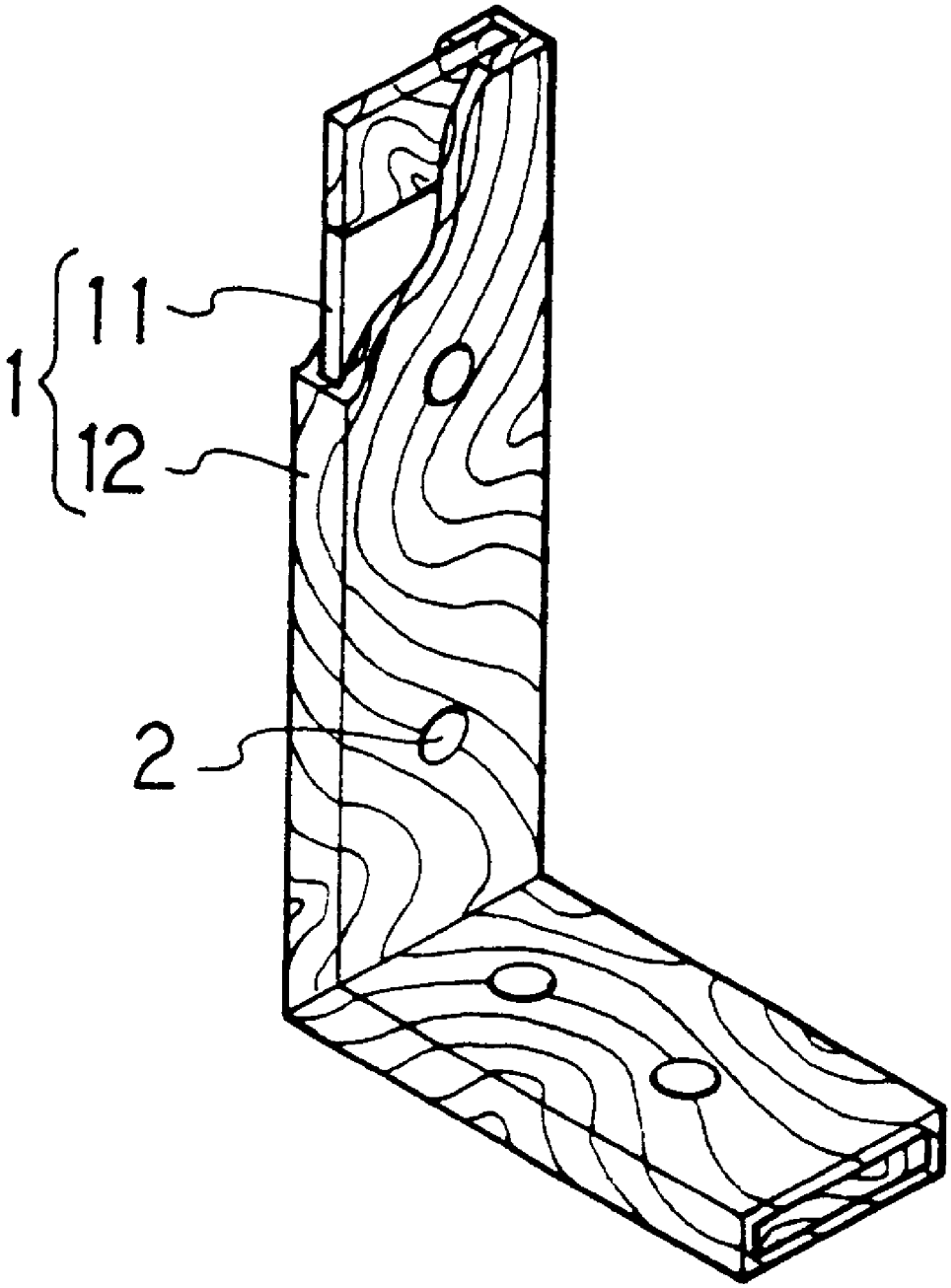
FIG. 1 is a perspective view of a fastener according to a first embodiment of the present invention.

FIG. 1 shows a perspective view of a fastener according to a first embodiment of the present invention. As shown in FIG. 1, the fastener 1 according to this embodiment is formed by containing a core plate member made of metal 11 in a decorative member made of a wooden board 12. In the fastener 1, through-holes 2 are perforated in suitable positions.

Figure 2:
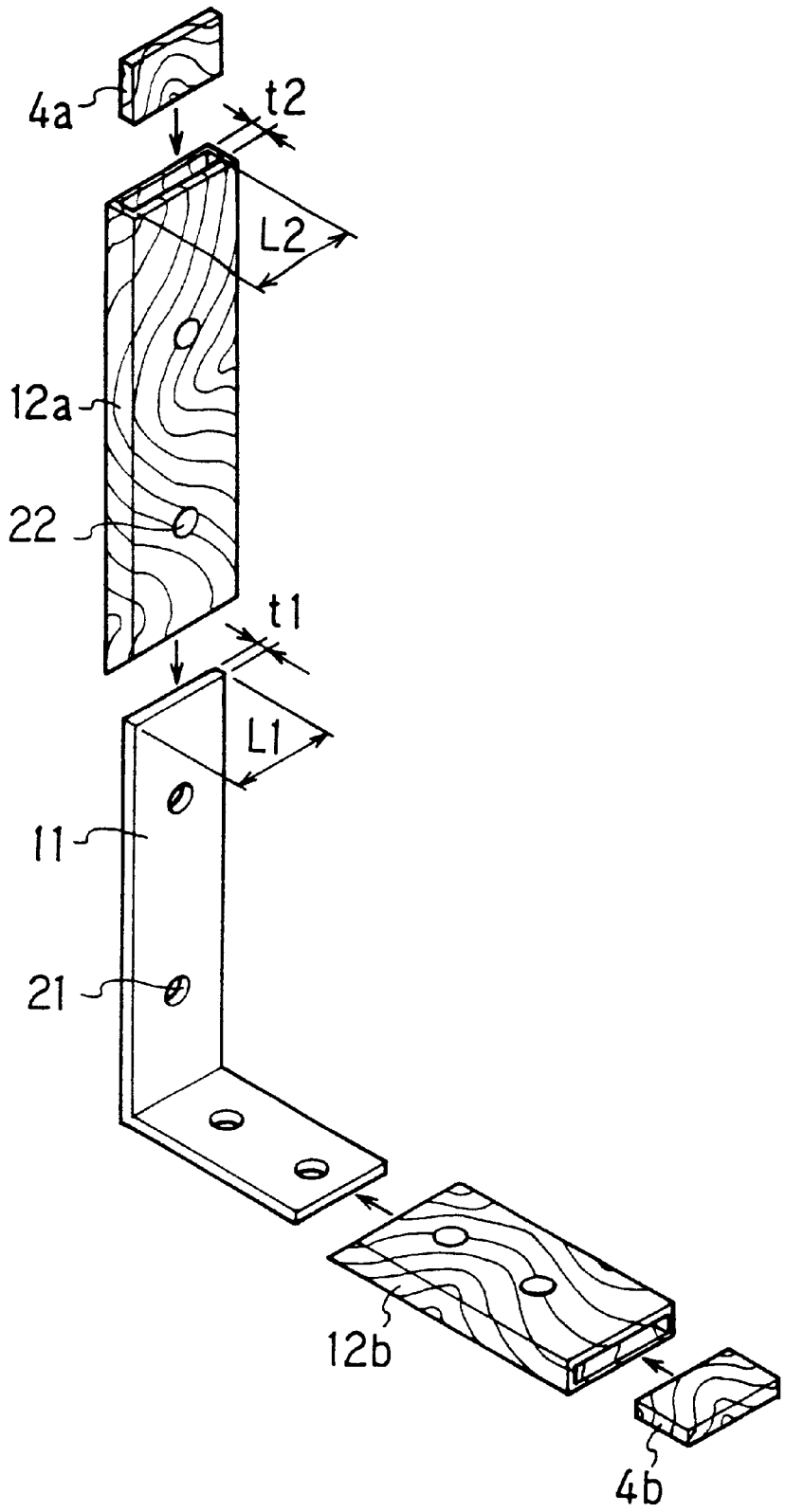
FIG. 2 is a perspective view of each member of the fastener in FIG. 1.

FIG. 2 shows a perspective view of each member of the fastener 1 according to this embodiment. As shown in FIG. 2, in the core plate member 11 of the fastener 1, holes (hereinafter referred to as through-holes) 21 that pass through the core plate member 11 are perforated in suitable positions. The decorative member 12 of the fastener 1 comprises a first decorative member 12*a*, a second decorative member 12*b*, and sealing members 4*a* and 4*b* that fill the top portions of the decorative members 12*a* and 12*b*. Holes (hereinafter referred to as through-holes) 22 that pass through the decorative members 12*a* and 12*b* are perforated in suitable positions in the first and second decorative members 12*a* and 12*b*. The through-holes 21 of the core plate member 11 and the through-holes 22 of the decorative members 12*a* and 12*b* are formed in such a manner that the centers of the corresponding through-holes substantially align in forming the fastener 1. These through-holes form the through-holes 2 of the fastener 1. The specific structure of the fastener 1 will be described below.

In the first and second decorative members 12*a* and 12*b* of the decorative member 12, the central portions of the wooden boards are hollowed out in such a shape that the core plate member 11 can be contained, as shown in FIG. 2. Here, the first decorative member 12*a* is described. The central portion of the first decorative member 12*a* is hollowed out by such dimensions (a long side dimension L2 and a short side dimension t2) that the core plate member 11 is placed in the first decorative member 12*a* with little or no clearance, according to the dimensions of the core plate member 11 (a long side dimension L1 and a short side dimension t1). The difference between the long side dimensions of the core plate member 11 and the first decorative member (L2–L1) is preferably 1 mm or less. Also, the difference between the short side dimensions (t2–t1) is preferably 1 mm or less. In the second decorative member 12*b*, the central portion of the wooden board is hollowed out using a lathe by such dimensions that the portion of the core plate member 11 to be contained therein is placed in the second decorative member 12*b* with little or no clearance as in the first decorative member 12*a*. An automatic control lathe can be used as the lathe.

The fastener 1 is formed by combining the first decorative member 12*a*, the second decorative member 12*b*, the core plate member 11, and the sealing members 4*a* and 4*b* that fill the top portions of the decorative members 12*a* and 12*b*, each of which is formed as described above. The bonding portion of each member is adhered using an adhesive comprising an acrylic resin, an epoxy resin, a phenol resin, a resorcin resin, a furan resin, a urea resin, a melamine resin, a polyester resin, a polyurethane resin, poly(vinyl acetate), nitrocellulose, or the like.

According to this embodiment, the fastener 1 is formed by containing the core plate member made of metal 11 in the decorative member made of the wooden board 12 as described above. Therefore, the fastener 1 is made of wood in appearance and has at least a certain strength.

Accordingly, when wooden furniture is fastened using the fastener 1 according to this embodiment, the fastener 1 looks good and does not spoil the appearance of the wooden furniture because both the furniture and the fastener 1 are made of wood in appearance. In addition, when the wooden furniture is fastened using the fastener 1 according to this embodiment, since the portion in contact with a side of the furniture (for fastening to the floor) or the top surface of the furniture (for fastening to the wall) is a wooden board, the wooden board serves as a cushioning material. Therefore, flaws are not easily made. Furthermore, when the wooden furniture is fastened using the fastener 1 according to this embodiment, wood and wood contact with each other as described above. Therefore, sliding occurs less easily than in the case where metal and wood contact with each other. Thus, a firmer fastening can be performed.

Figure 3:
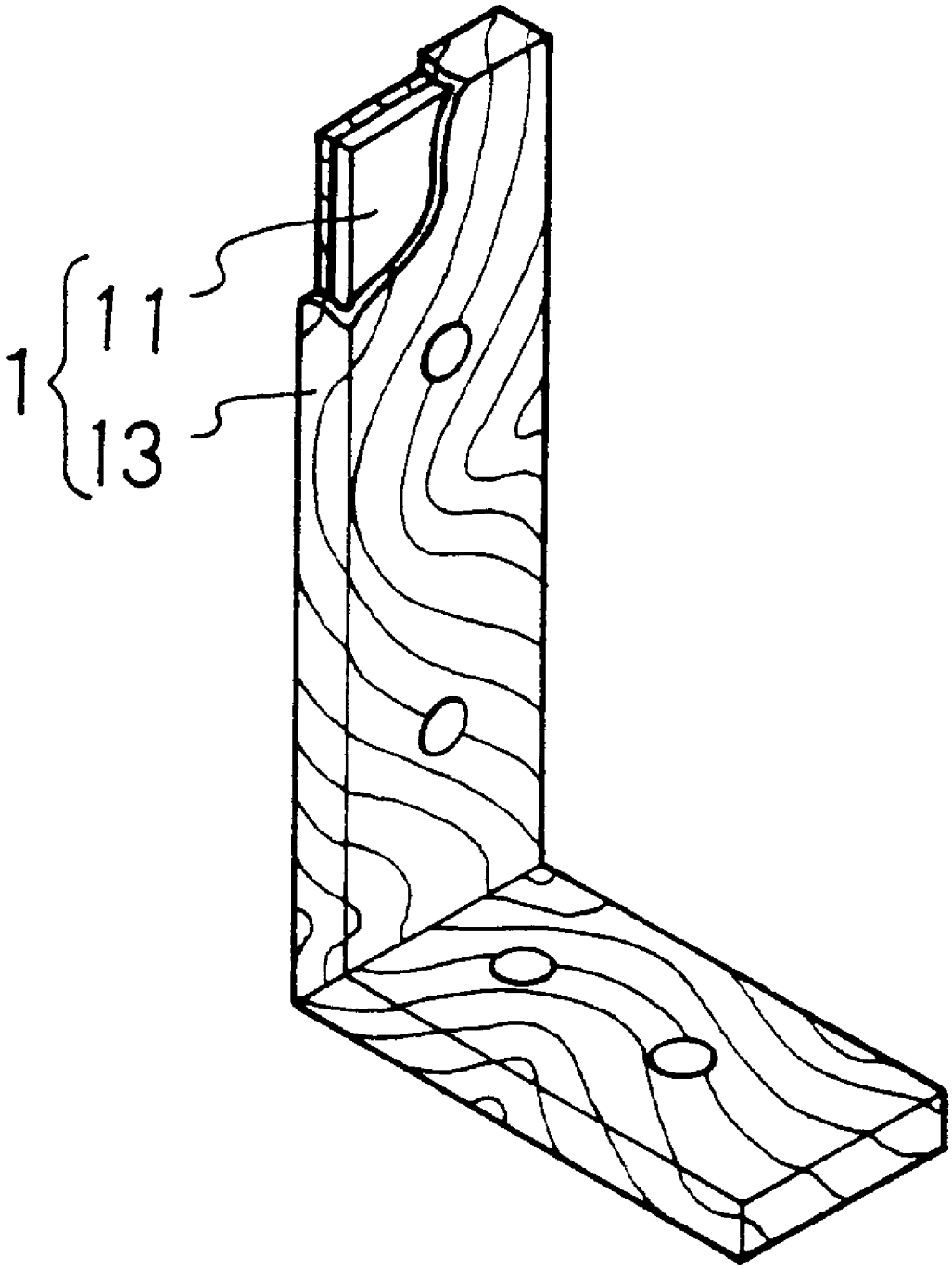
FIG. 3 is a perspective view of a fastener according to a second embodiment of the present invention.
Figure 4:
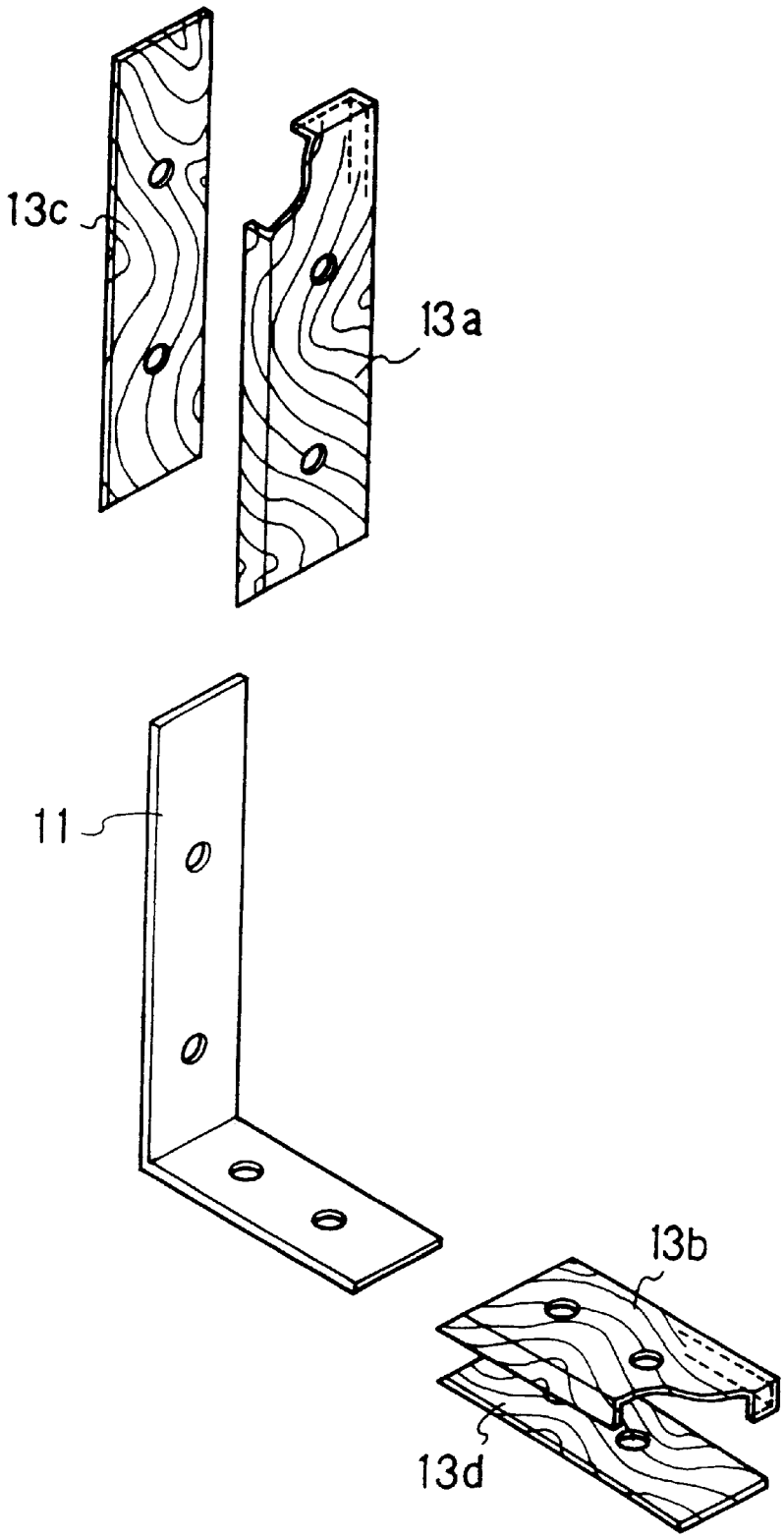
FIG. 4 is a perspective view of each member of the fastener in FIG. 3.

FIG. 3 shows a perspective view of a fastener according to a second embodiment of the present invention. This embodiment is different from the first embodiment in the shape of each member of the decorative member. FIG. 4 shows a perspective view of each member of a decorative member 13 according to this embodiment. As is apparent from FIGS. 3 and 4, the decorative member according to this embodiment comprises a first decorative member 13*a*, a second decorative member 13*b*, a third decorative member 13*c*, and a fourth decorative member 13*d*. Other structures and functions in this embodiment are basically the same as the first embodiment.

In addition, the shape of each member of the decorative member in the present invention is not limited to the shapes described in the above embodiments. For example, the decorative member may be formed by using wood from thinning or the like and laminating wooden boards worked into suitable shapes.

Figure 5:
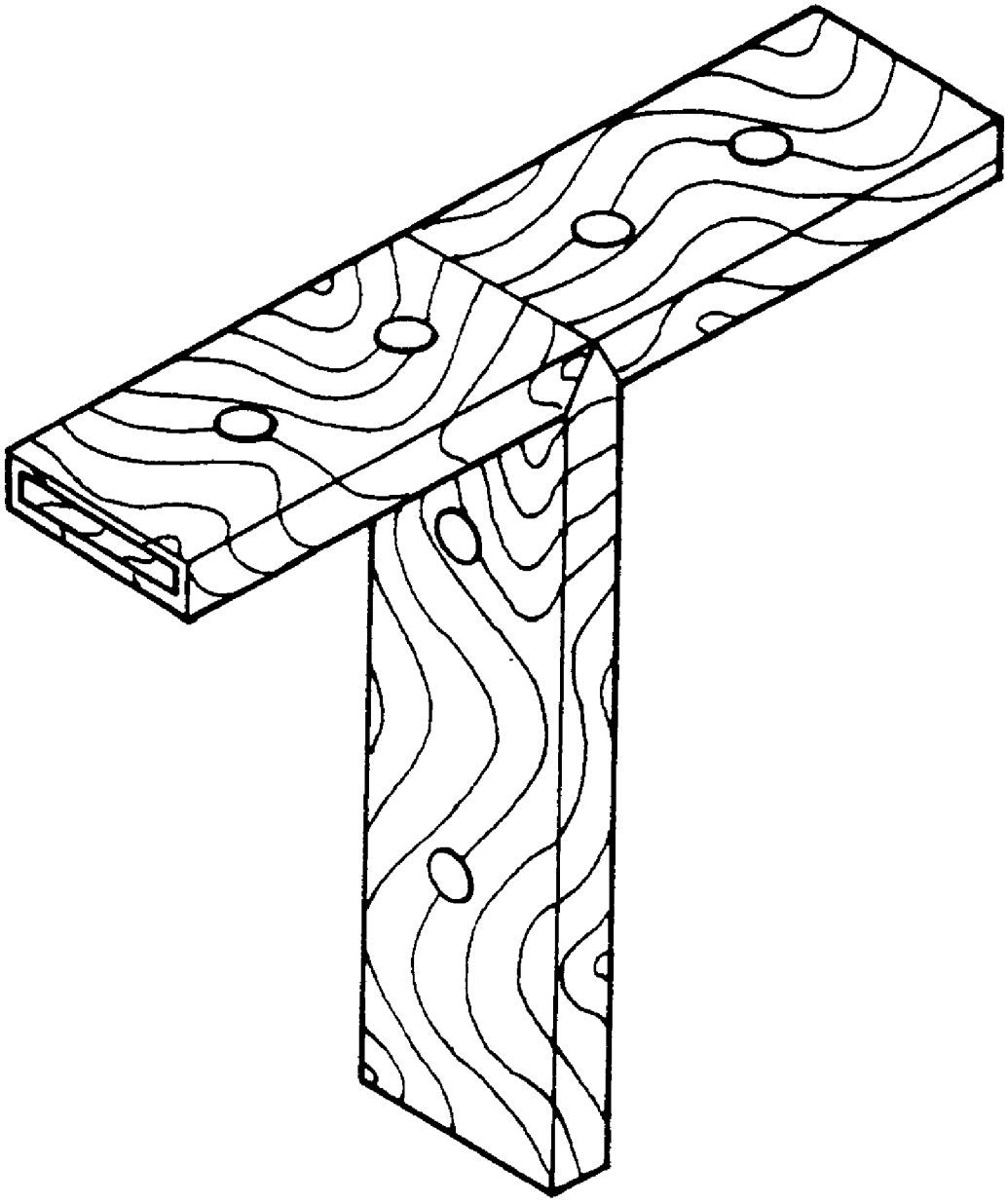
FIG. 5 is a perspective view of a fastener (T type) according to another embodiment of the present invention.
Figure 6:
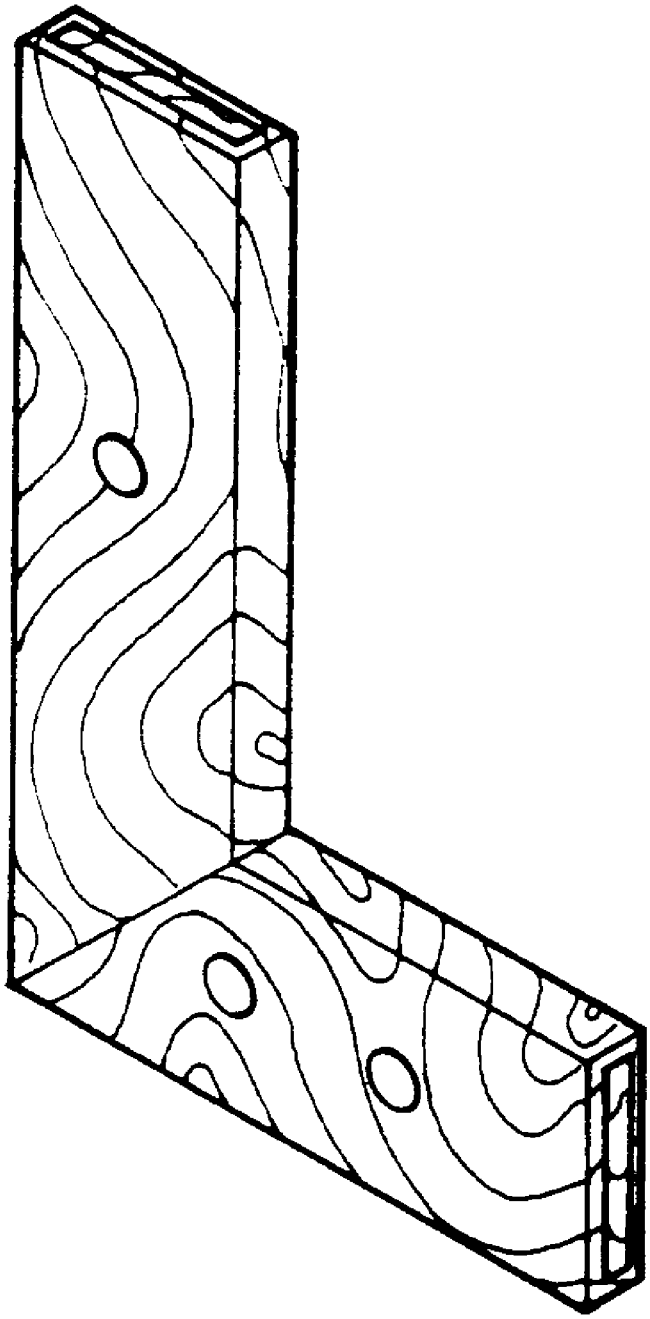
FIG. 6 is a perspective view of a fastener (flat L type) according to another embodiment of the present invention.
Figure 7:
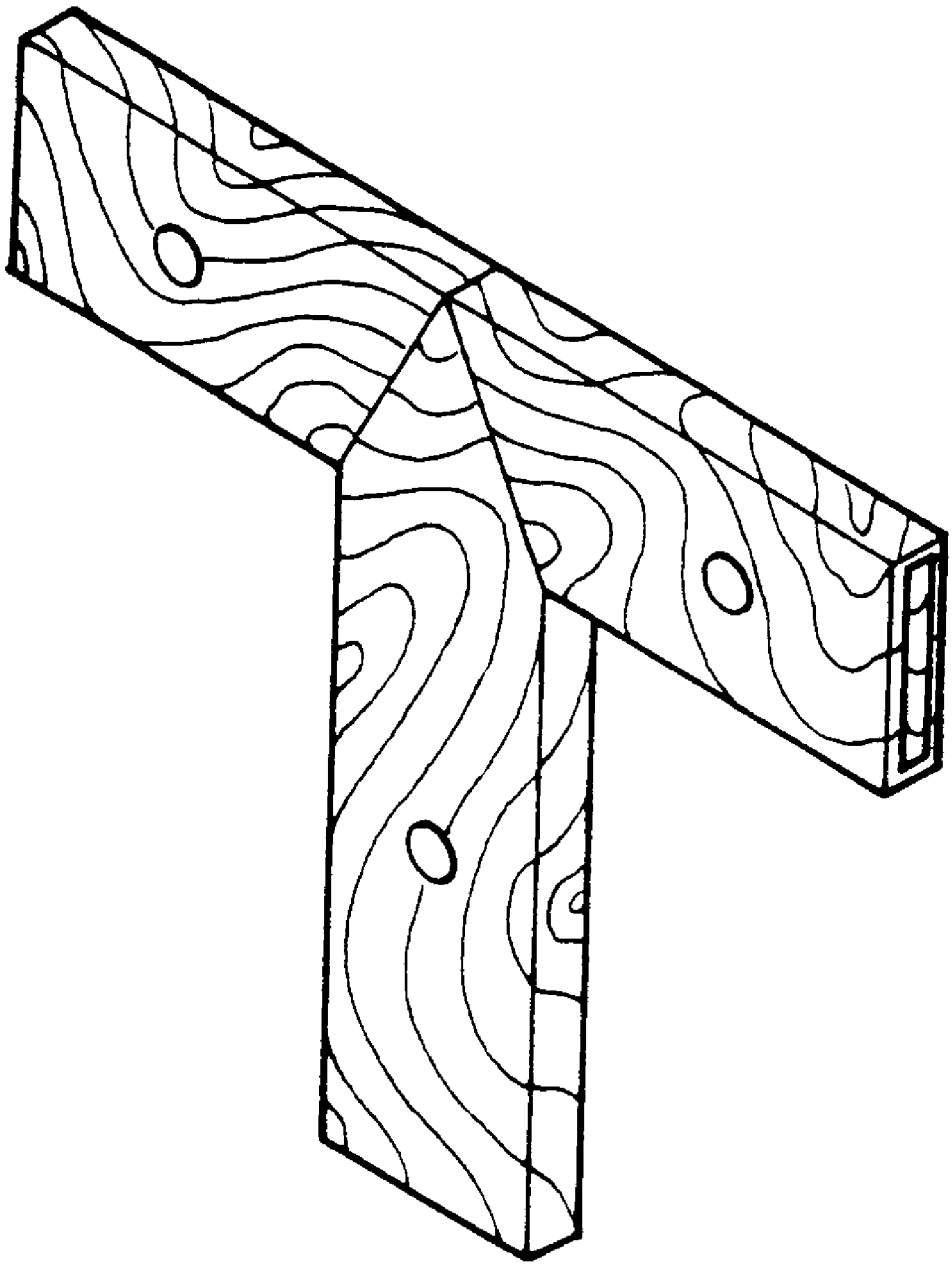
FIG. 7 is a perspective view of a fastener (flat T type) according to another embodiment of the present invention.
Figure 8:
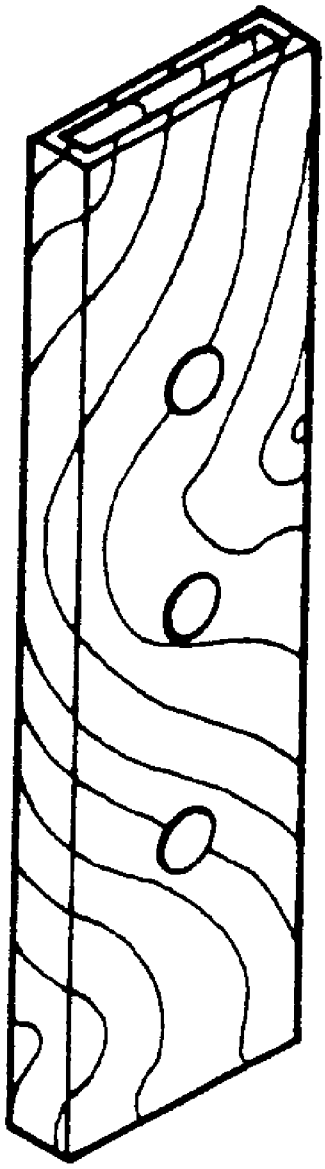
FIG. 8 is a perspective view of a fastener (I type) according to another embodiment of the present invention.

In the above embodiments, the case where the fastener is of L type is described. However, the present invention is not limited to this case. For example, the fastener may be of T type as shown in FIG. 5, flat L type as shown in FIG. 6, flat T type as shown in FIG. 7, I type as shown in FIG. 8, or other shapes. That is, a fastener of suitable type can be selected according to the kind, shape, location and fastening method (for example, fastening the top surfaces of the furniture with each other) of the furniture.

In the above embodiments, it is preferable to make the through-holes 22 of the decorative member 12 smaller than the through-holes 21 of the core plate member 11 when intending to screw screws into the through-holes 22 perforated through the decorative member 12 in fastening the furniture. In addition, it is preferable to make the through-holes 21 of the core plate member 11 smaller than the through-holes 22 of the decorative member 12 when intending to screw screws into the through-holes 21 perforated through the core plate member 11. That is, the through-holes 22 of the decorative member 12 function as threaded holes (the through-holes 2) in the former case, and the through-holes 21 of the core plate member 11 function as the threaded holes (the through-holes 2) in the latter case. Here, the case where the screws are screwed into the through-holes 2 is described. However, the present invention is not limited to this structure. The furniture may be fastened by making the through-holes 2 larger than the screws so that the screws are not screwed into the through-holes 2 and using the screws passing through the through-holes 2.

In the above embodiments, the case where the furniture is fastened by providing the through-holes 2 in the fastener 1 and using the screws is described. However, the present invention is not limited to this case. For example, the furniture may be fastened by using the fastener and the adhesive without providing the threaded holes (the through-holes), or the furniture may be fastened by using the fastener provided with the threaded holes (the through-holes), the screws, and the adhesive.

In addition, iron, aluminum, stainless steel or the like is used as the material for forming the core plate member 11 of the fastener 1 in the above embodiments. In order to prevent corrosion as required, iron or the like may be subjected to a surface treatment such as galvanization or coating. Furthermore, the material for forming the decorative member 12 can be selected properly according to the furniture to be fastened. For example, Sugi, Hinoki, or Sakura is used. However, the present invention is not limited to these materials.

Figure 10:
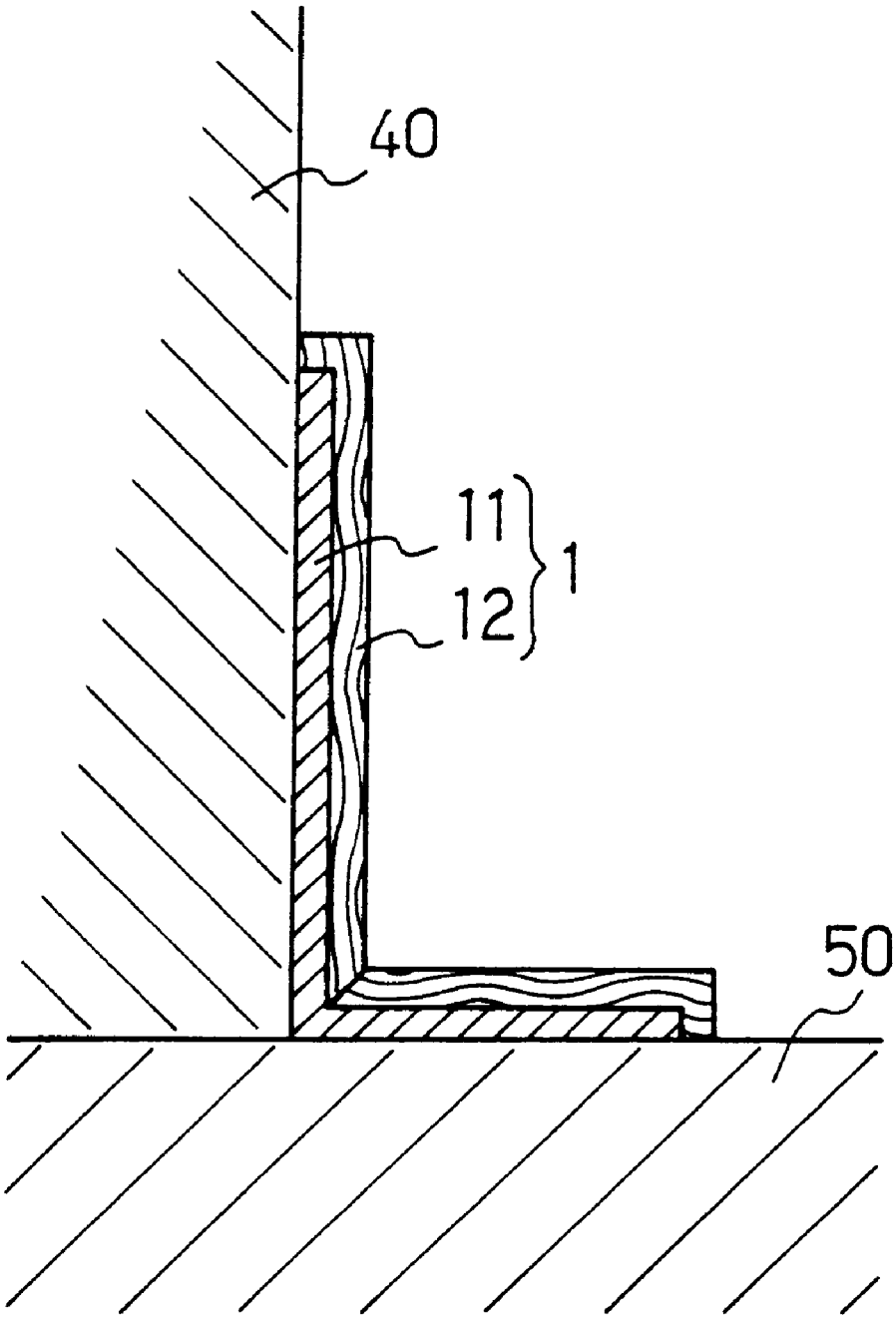
FIG. 10 is a cross-sectional view showing a state in which furniture is fastened to the building (the floor) using a fastener according to the present invention.
Figure 11:
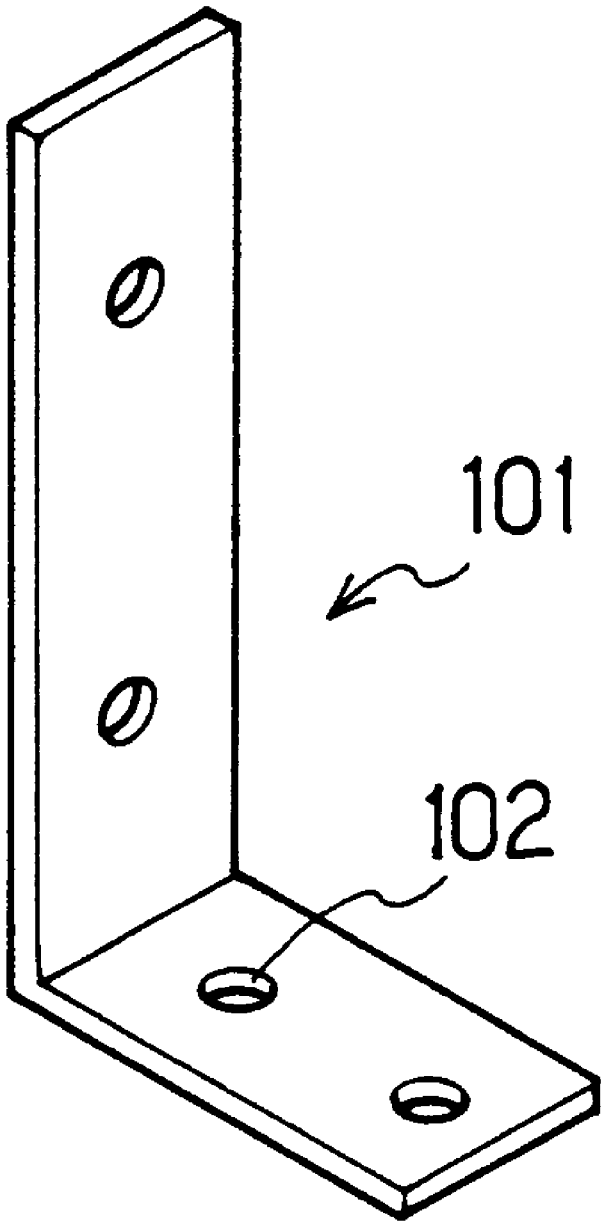
FIG. 11 is a perspective view of a fastener according to prior art.
Figure 12:
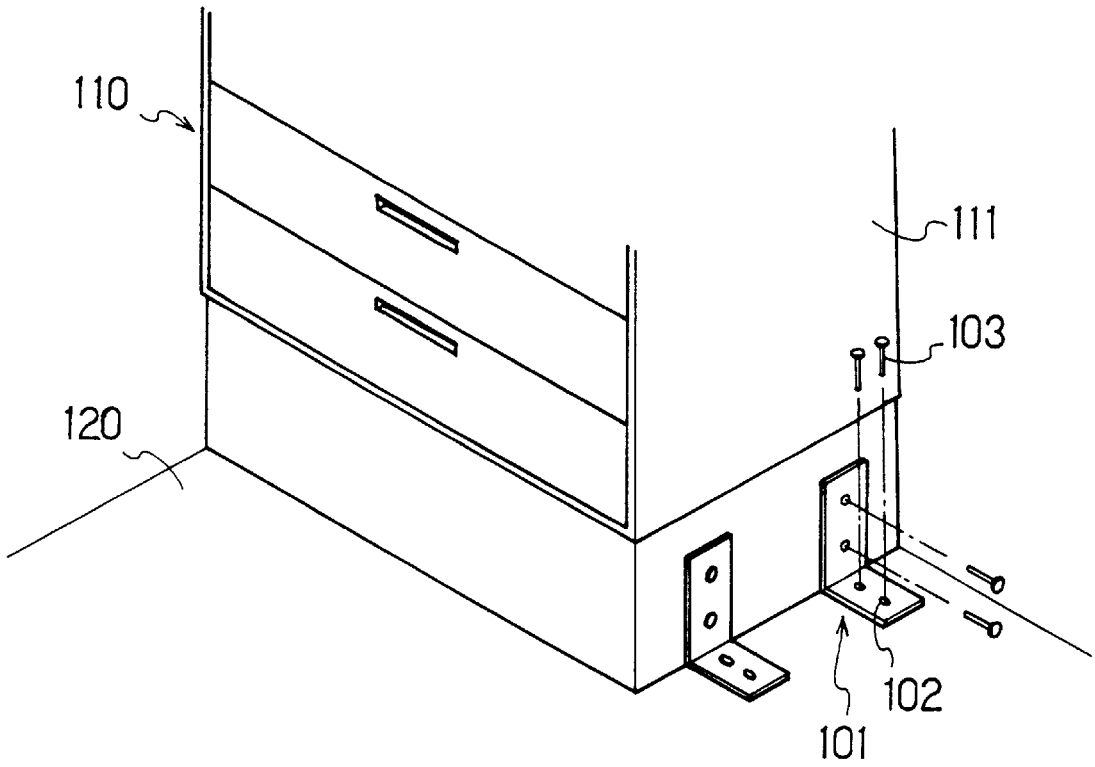
FIG. 12 is a perspective view showing a state in which furniture is fastened to the building (the floor) using a fastener according to prior art.
Figure 13:
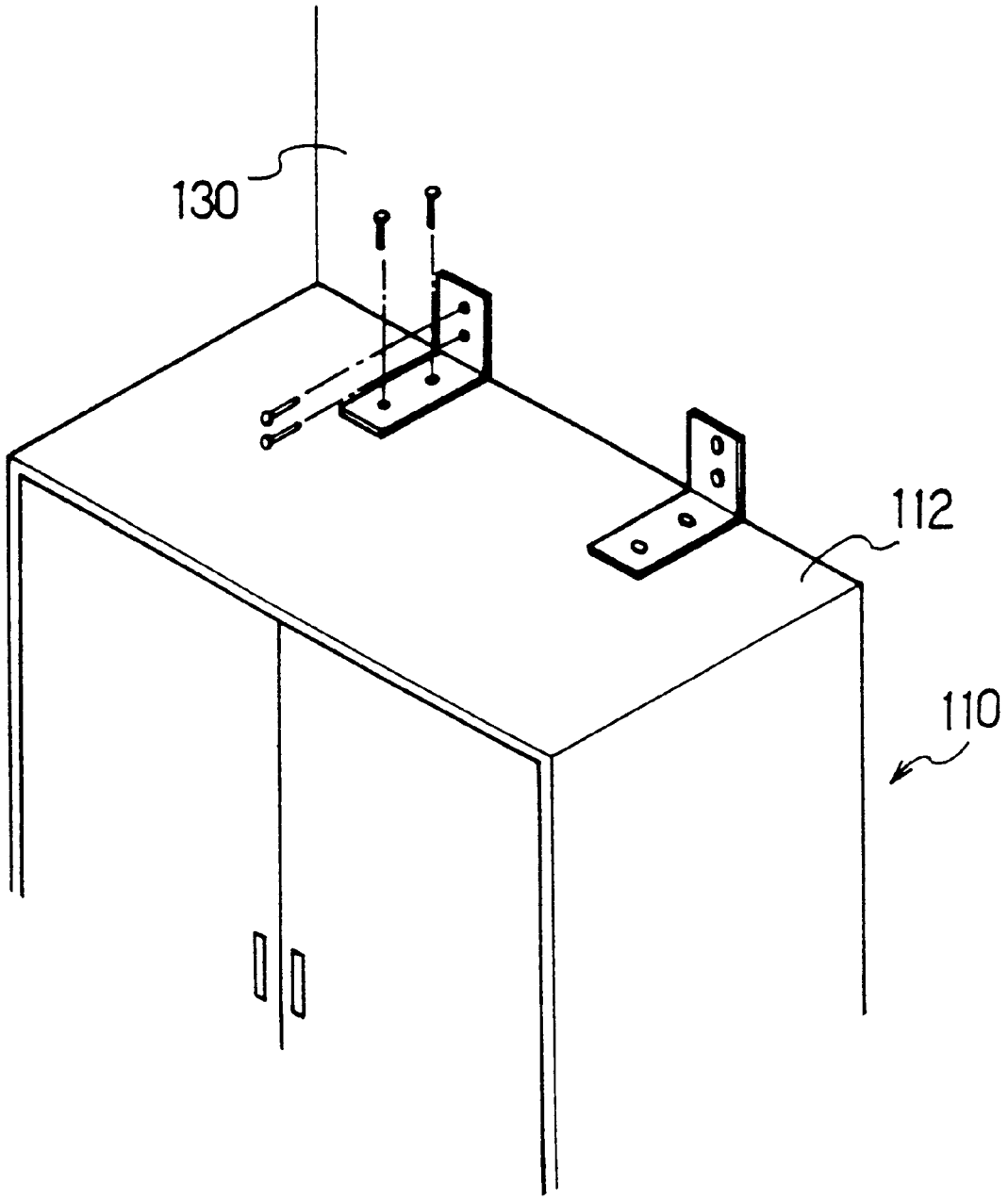
FIG. 13 is a perspective view showing a state in which furniture is fastened to the building (the wall) using a fastener according to prior art.

In the above embodiments, the fastener 1 in which the entire core plate member 11 is covered with the decorative member 12 is described. However, the present invention is not limited to this. For example, in the case of fastening a furniture 40 to a floor 50, the fastener 1 may be formed in such a manner that the decorative member 12 covers only the portions where the core plate member 11 does not contact with the furniture 40 and the floor 50, that is, the exposed portions of the core plate member 11, as shown in FIG. 10.

Figure 9:
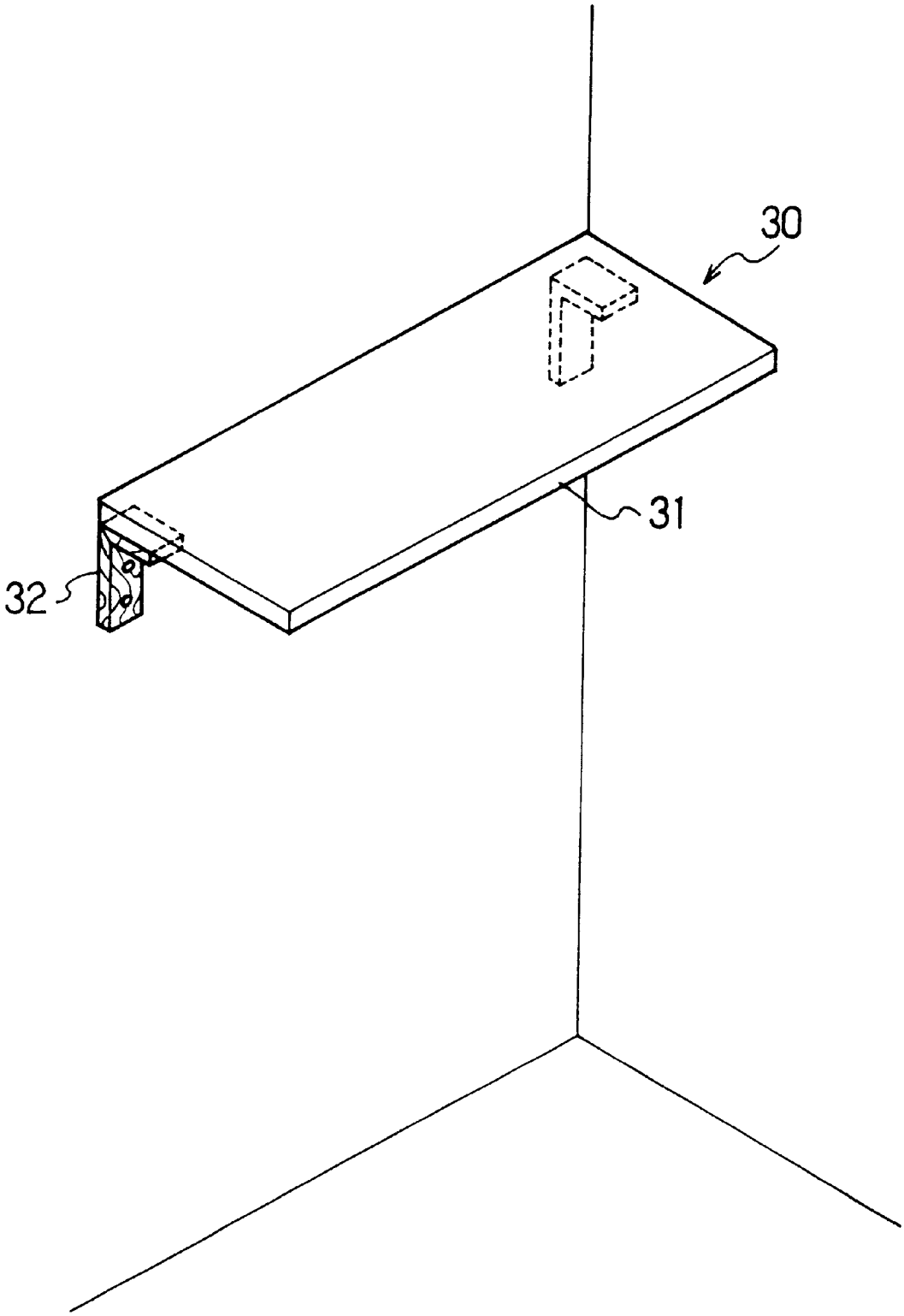
FIG. 9 is a perspective view showing a state in which a shelf is formed by using a fastener according to the present invention.

In the above embodiments, the fastening of the furniture is described as the application of the fastener. However, the present invention is not limited to this application. For example, the fastener according to the first embodiment may be used as a shelf support 32 for fastening a shelf board 31 in making a shelf 30 as shown in FIG. 9. According to this application, a shelf that provides a beautiful appearance can be made.

In addition, the thickness of the wood portions of the wooden decorative members 12 and 13 in the above embodiments is preferably about 1–10 mm. The thickness of the core plate member placed inside is preferably about 1–5 mm. The total thickness of the fastener 1 is preferably about 5–20 mm.

Industrial Applicability

As described above, according to the present invention, the fastener that does not spoil the appearance of the wooden furniture, does not make flaws easily, does not cause sliding easily, and is excellent in integrity when fastening the wooden furniture can be obtained.

What is claimed is:

1. A fastener having a predetermined shape and adapted to attach furniture to a base, the fastener comprising:

a core plate member made of metal; and a decorative member made of wood, the decorative member adapted to completely cover the core plate member, wherein the core plate member and the decorative member form an integrated structure and holes passing through the core plate member and the decorative member are formed so that the decorative member functions as a cushioning material to prevent the wooden furniture from being flawed and from easily sliding with respect to the fastener to improve the integrity of the attachment between the furniture and the fastener.

2. The fastener according to claim 1, wherein the core plate member made of metal is one piece, and the decorative member made of wood comprises a plurality of members, the plurality of wooden decorative members being integrated by adhesion.

3. The fastener according to claim 1, wherein the decorative member is formed by using a wooden board whose central portion is hollowed out.

4. The fastener according to claim 1, wherein the decorative member is formed by laminating wooden boards.

5. The fastener according to claim 1, wherein the fastener is at least one material selected from the group consisting of an L-type material, a T-type material, an I-type material, a flat L-type material, and a flat T-type material.

6. The fastener according to claim 1, wherein among the holes passing through the core plate member and the decorative member, the hole of the core plate member is smaller than the hole of the decorative member.

7. The fastener according to claim 1, wherein the core plate member and the decorative member are integrated by adhesion of the core plate member and the decorative member.

8. The fastener according to claim 1, wherein among the holes passing through the core plate member and the decorative member, the hole of the decorative member is smaller than the hole of the core plate member.

* * * * *